US010939193B1

(12) United States Patent
Cao et al.

(10) Patent No.: US 10,939,193 B1
(45) Date of Patent: Mar. 2, 2021

(54) IN-EAR DETECTION METHOD FOR A WIRELESS EARPHONE AND A WIRELESS EARPHONE

(71) Applicant: Ifory Limited, Hong Kong (CN)

(72) Inventors: Jiaoping Cao, Hong Kong (CN); Zhenhua Liu, Hong Kong (CN); Yun Feng, Hong Kong (CN)

(73) Assignee: IFORY LIMITED, Hong Kong (CN)

( * ) Notice: Subject to any disclaimer, the term of this patent is extended or adjusted under 35 U.S.C. 154(b) by 0 days.

(21) Appl. No.: 16/875,654

(22) Filed: May 15, 2020

(30) Foreign Application Priority Data

Mar. 2, 2020 (CN) ..... 202010135489.9

(51) Int. Cl.
*H04R 1/10* (2006.01)

(52) U.S. Cl.
CPC ..... *H04R 1/1041* (2013.01); *H04R 1/1016* (2013.01); *H04R 2420/07* (2013.01)

(58) Field of Classification Search
CPC .. H04R 1/1041; H04R 1/1016; H04R 1/1058; H04R 2420/07; H04R 2225/025; H04R 2225/39; H04R 5/033; H04R 5/04; H04R 2201/107; H04R 25/652; H04R 25/456; H04R 25/65; H04R 25/60; H04R 25/30; H04R 25/305
USPC ..... 381/74, 328, 380
See application file for complete search history.

(56) References Cited

U.S. PATENT DOCUMENTS

2017/0064429 A1* 3/2017 Hirsch ..... H04W 52/0209
2017/0347180 A1* 11/2017 Petrank ..... G10L 25/51
2020/0186910 A1* 6/2020 Kemmerer ..... G06F 3/165

FOREIGN PATENT DOCUMENTS

CN 104106112 B 3/2017
CN 108810788 A 11/2018

* cited by examiner

*Primary Examiner* — Ahmad F. Matar
*Assistant Examiner* — Sabrina Diaz
(74) *Attorney, Agent, or Firm* — Birch, Stewart, Kolasch & Birch, LLP

(57) ABSTRACT

Disclosed are an in-ear detection method for a wireless earphone and a wireless earphone. This method includes acquiring a position parameter sent by a position detection module; determining that the wireless earphone has left a charging box based on the position parameter; controlling an audio playback module to emit a detection acoustic wave; acquiring a detection signal and identifying acoustic parameters of the detection signal, the detection signal being generated from a reflected wave of the detection acoustic wave collected by an acoustic wave sensor; and determining whether the wireless earphone is worn in a user's ear based on the acoustic parameters.

8 Claims, 3 Drawing Sheets

IN-EAR DETECTION METHOD FOR A WIRELESS EARPHONE AND A WIRELESS EARPHONE

CROSS-REFERENCE TO RELATED APPLICATION

This application claims priority to a Chinese patent application No. 202010135489.9 filed on Mar. 2, 2020, disclosure of which is incorporated herein by reference in its entirety.

TECHNICAL FIELD

The present disclosure relates to a technical field of earphones and, in particular, to an in-ear detection method for a wireless earphone and a wireless earphone.

BACKGROUND

Current earphones can be divided into wired earphones and wireless earphones. The wired earphones require left and right earphones to form left and right channels through wired connection to produce a stereo effect, and thus are very inconvenient to wear. The wireless earphones communicate with terminals through wireless communication protocols such as Bluetooth. Compared with the wired earphones, the wireless earphones have the characteristics of no need to clean up data cables and convenience to use. Thus, the wireless earphones are becoming more and more popular due to their convenient wearing and stand-alone use.

In the related art, whether a wireless earphone is worn in place is usually detected by one or more optical sensors. For example, an optical sensor is used to detect the light intensity of the reflected light to determine whether the wireless earphone is worn in a user's ear. In addition, a Chinese patent application No. 201810601224.6 discloses a method and device for detecting a wearing state of a wireless earphone and a wireless earphone. The method in this patent application includes: acquiring a first light value collected by a first optical sensor and a second light value collected by a second optical sensor, where the first optical sensor and the second optical sensor are respectively disposed at an in-ear position and a non-in-ear position of the wireless earphone; and determining whether the wireless earphone is in a worn state according to a difference between the first light value and the second light value.

Due to the limited characteristics of the optical sensor, an opening needs to be provided on the wireless earphone to install the optical sensor. Such configuration makes the appearance design of the wireless earphone incomplete, which is not conducive to the overall seal and beauty of the product. Furthermore, high cost of the optical sensor may further increase the cost of wireless earphone. In addition, if the consumer wears the earphone incorrectly, it is easy for the optical sensor to make a mistake.

SUMMARY

The present disclosure provides an in-ear detection method for a wireless earphone and a wireless earphone to solve the product sealing and aesthetic problems caused by an opening that is made on a wireless earphone due to a limitation of the characteristics of an optical sensor for in-ear detection by the wireless earphone in the related art.

According to an aspect of the present disclosure, there is provided an in-ear detection method for a wireless earphone. The in-ear detection method for a wireless earphone includes acquiring a position parameter sent by a position detection module; determining that the wireless earphone has left a charging box based on the position parameter; controlling an audio playback module to emit a detection acoustic wave; acquiring a detection signal and identifying acoustic parameters of the detection signal, the detection signal being generated from a reflected wave of the detection acoustic wave collected by an acoustic wave sensor; and determining whether the wireless earphone is worn in a user's ear based on the acoustic parameters.

Preferably, the in-ear detection method for the wireless earphone further includes if it is determined that the wireless earphone is worn in the user's ear, controlling the audio playback module to play audio.

Preferably, the acoustic parameters comprise a waveform parameter and a frequency parameter, and determining whether the wireless earphone is worn in the user's ear based on the acoustic parameters includes determining whether the waveform parameter matches a first preset waveform; if the waveform parameter matches the first preset waveform, determining whether the frequency parameter matches a first preset frequency; and if the frequency parameter matches the first preset frequency, determining that the wireless earphone is worn in the user's ear.

Preferably, after determining that the wireless earphone is worn in the user's ear and prior to controlling the audio playback module to play audio, the in-ear detection method further includes determining whether the user's ear is healthy based on the acoustic parameters.

Preferably, determining whether the user's ear is healthy based on the acoustic parameters includes determining whether the waveform parameter matches a second preset waveform and whether the frequency parameter matches a second preset frequency; and if the waveform parameter matches the second preset waveform and the frequency parameter matches the second preset frequency, determining that the user's ear is healthy, otherwise determining that the user's ear is unhealthy.

Preferably, determining whether the user's ear is healthy based on the acoustic parameters further includes if it is determined that the user's ear is healthy or unhealthy, sending, by a transmission module, a result that the user's ear is healthy or unhealthy to a mobile terminal.

Preferably, determining that the wireless earphone has left the charging box based on the position parameter includes comparing a displacement L of the wireless earphone with a first preset threshold L1, wherein the position parameter is the displacement L of the wireless earphone; and if $L>L1$, determining that the wireless earphone has left the charging box Preferably, after determining that the wireless earphone has left the charging box and prior to controlling the audio playback module to emit the detection acoustic wave, the in-ear detection method further includes comparing the displacement L with a second preset threshold L2 and a third preset threshold L3, where $L2<L3$; and if $L2 \leq L \leq L3$, controlling the audio playback module to emit the detection acoustic wave.

According to another aspect of the present disclosure, there is provided a wireless earphone, which includes a data processing module as well as a position detection module, an audio playback module and an acoustic wave sensor that are connected to the data processing module. The position detection module is configured to acquire a position parameter of the wireless earphone. The audio playback module is configured to emit a detection acoustic wave after receiving a playback instruction. The acoustic wave sensor is configured to collect a reflected wave of the detection acoustic wave and generate a detection signal. The data processing module is configured to perform operations of receiving the position parameter and determining that the wireless earphone has left the charging box based on the position parameter; controlling the audio playback module to emit a detection acoustic wave; and receiving and identifying acoustic parameters of the detection signal and determining whether the wireless earphone is worn in a user's ear based on the acoustic parameters.

Preferably, the wireless earphone further includes a transmission module connected to the data processing module. The transmission module is configured to receive a result that the user's ear is healthy or unhealthy sent by the data processing module and send the result to a mobile terminal.

The present disclosure provides an in-ear detection method for a wireless earphone and a wireless earphone. The in-ear detection method for the wireless earphone includes acquiring a position parameter sent by a position detection module; determining that the wireless earphone has left a charging box based on the position parameter; controlling an audio playback module to emit a detection acoustic wave; acquiring a detection signal and identifying acoustic parameters of the detection signal, the detection signal being generated from a reflected wave of the detection acoustic wave collected by an acoustic wave sensor; and determining whether the wireless earphone is worn in a user's ear based on the acoustic parameters. The in-ear detection method for the wireless earphone uses an acoustic wave to determine whether the wireless earphone is worn in the user's ear. Compared with the related art, the in-ear detection method for the wireless earphone does not need an optical sensor, and thus does not need a light-transmitting opening on the wireless earphone, thereby simplifying the structure of the wireless earphone, reducing the manufacturing costs, and fully releasing design space of the wireless earphone to provide higher design flexibility.

Figure 1:
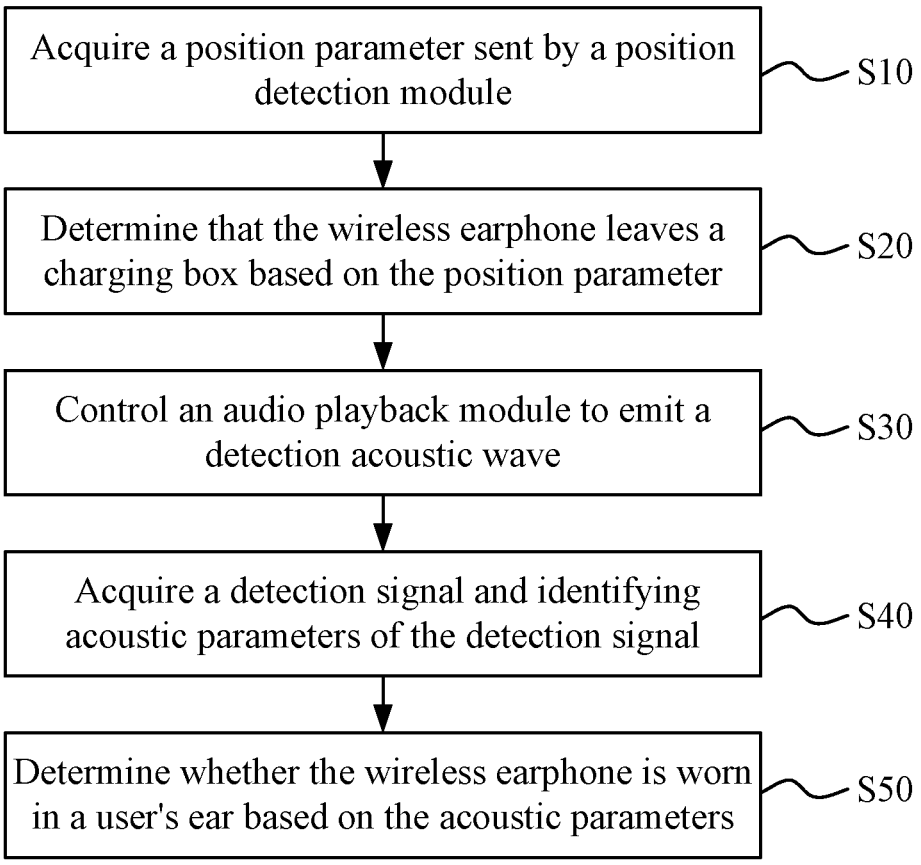
FIG. 1 is a first flowchart of an in-ear detection method for a wireless earphone according to an embodiment of the present disclosure.

In the figures: 1—data processing module; 2—position detection module; 3—audio playback module; 4—acoustic wave sensor; and 5—transmission module.

DETAILED DESCRIPTION

To make the objectives, technical solutions and advantages of embodiments of the present disclosure clearer, the technical solutions in the embodiments of the present disclosure will be described clearly and completely in combination with the drawings in the embodiments of the present disclosure. Apparently, the described embodiments are part (not all) of the embodiments of the present disclosure. Components of the embodiments of the present disclosure, generally described and illustrated in the drawings herein, may be configured and designed in various configurations.

Therefore, the detailed description of the embodiments of the present disclosure provided in the drawings below is not intended to limit the scope of the claimed disclosure, but merely to represent selected embodiments of the present disclosure. Based on the embodiments in the present disclosure, all other embodiments obtained by those of ordinary skill in the art without creative labor shall fall within the scope of the present disclosure.

It should be noted that similar reference numerals and letters indicate similar items in the drawings below. Thus, once an item is defined in one drawing, it need not be further defined and explained in the subsequent drawings.

In the description of the present disclosure, it should be noted that orientations or position relations indicated by terms "upper", "lower", "left", "right", "vertical", "horizontal", "in", "out" and the like are orientations or position relations based on the drawings, or orientations or position relations in which the product of the claimed disclosure is usually placed during use. These orientations or position relations are only for the convenience of describing the present disclosure and simplifying the description, and do not indicate or imply that a device or element referred to must have such specific orientations, or be configured or operated in such specific orientations. Thus, these orientations or position relations shall not be construed as limiting the present disclosure. In addition, terms "first", "second", "third" and the like are only used to distinguish descriptions, and shall not be construed as indicating or implying the relative importance. In the description of the present disclosure, unless otherwise stated, the meaning of "plurality" is two or more.

In the description of the present disclosure, it should also be noted that terms "disposed" and "connected" shall be understood in a broad sense unless otherwise expressly specified and limited. For example, the term "connected" may refer to "fixedly connected", "detachably connected" or "integrally connected". In addition, the term "connected" may also refer to "mechanically connected" or "electrically connected". For those of ordinary skill in the art, specific meanings of the above terms in the present disclosure may be understood according to specific situations.

In the present disclosure, unless otherwise explicitly stated and limited, a first feature "above" or "below" a second feature may include the first feature contacting with the second feature directly, and may also include the first feature contacting with the second feature indirectly by other feature therebetween. In addition, the first feature "above", "over" or "on" the second feature includes the first feature directly above or diagonally above the second feature, or only indicates the first feature higher in level than the second feature. The first feature "below", "underneath" or "under" the second feature includes the first feature directly below or diagonally below the second feature, or only indicates the first feature lower in level than the second feature.

Embodiments of the present disclosure will be described in detail below. Examples in the embodiments are illustrated in the drawings, where the same or similar reference numerals denote the same or similar elements, or elements having the same or similar functions throughout. The embodiments described below with reference to the drawings are exemplary and are only used to explain the present disclosure, but shall not be construed as limiting the present disclosure.

First Embodiment

Figure 3:
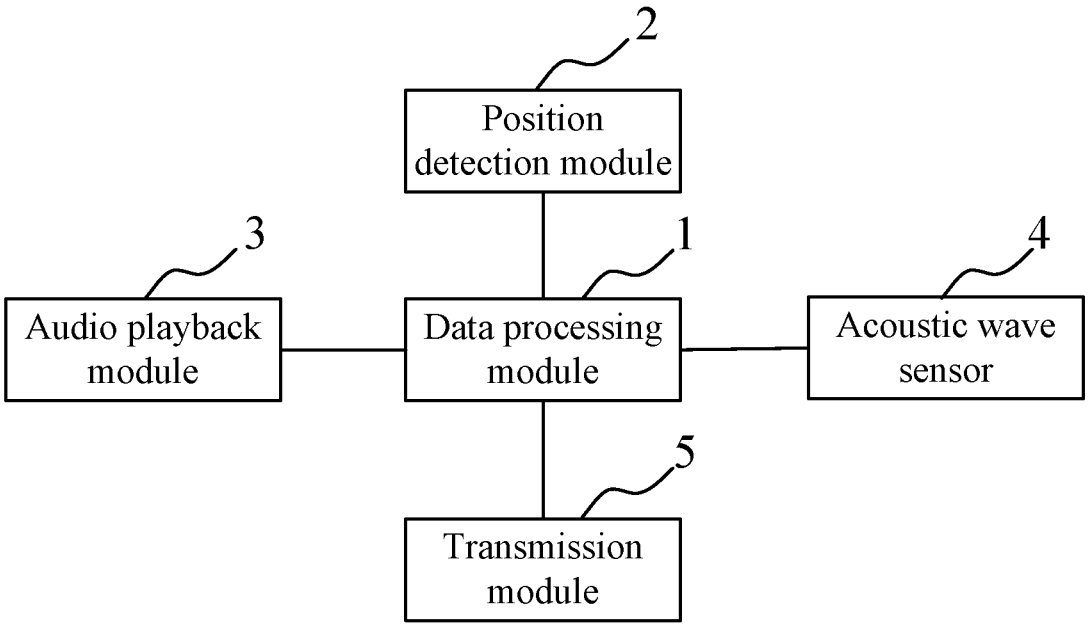
FIG. 3 is a block diagram of a wireless earphone according to an embodiment of the present disclosure.

This embodiment provides an in-ear detection method for a wireless earphone, which is applicable to a case where a wireless earphone is taken out of a charging box and worn in a use's ear. Wireless earphones achieve wireless communication based on communication protocols such as Bluetooth. The wireless earphone in the present disclosure may include an independent main wireless earphone, or a master earphone and a slave earphone in a pair. The wireless earphone may be an in-ear earphone or a semi-in-ear earphone. As shown in FIG. 3, the wireless earphone includes a position detection module 2, an audio playback module 3, an acoustic wave sensor 4, a data processing module 1 and a transmission module 5. Using a TWS wireless earphone provided with a master earphone and a slave earphone in a pair as an example, the master wireless earphone can send audio data received from a smart terminal such as a smartphone to the slave wireless earphone, or when necessary, the master and slave wireless earphones can achieve wireless communication with auxiliary equipment such as a charging box, so that the master wireless earphone, slave wireless earphone, charging box and smart terminal can constitute a wireless communication network to achieve communication with each other in an optional manner. The smart terminal stores audio data and uses its application program to manage the audio data, or displays the audio data and the use states (such as wearing situation and power) of the master and slave wireless earphones on the display screen.

As shown in FIG. 1, the in-ear detection method for the wireless earphone includes the steps described below.

In S10, a position parameter is acquired by a position detection module 2.

In S20, it is determined that the wireless earphone has left a charging box based on the position parameter.

Specifically, when the wireless earphone is in a charging box, the charging box can charge the wireless earphone. When the wireless earphone leaves the charging box, it is indicated that the wireless earphone may be used, but it may also not be used. The data processing module 1 receives the position parameter sent by the position detection module 2, determines a displacement of the wireless earphone based on the position parameter, and thereby determines whether the earphone has left the charging box. Specifically, the position parameter is a displacement L of the wireless earphone. The displacement L is compared with a first preset threshold L1 in the data processing module 1, where L1 is a depth value of the charging box. If $L>L1$, it is determined that the wireless earphone has left the charging box. If $L<L1$, it is determined that the wireless earphone has not left the charging box. In other embodiments, it can also be determined whether the earphone has left the charging box by checking whether the charging between the wireless earphone and the charging box is disconnected.

In this embodiment, the position detection module 2 is an acceleration sensor. The acceleration sensor may be a three-axis acceleration sensor with three sensors, so that accelerations in three orthogonal axes (i.e., X-axis, Y-axis, and Z-axis) can be detected and outputted in a form of three independent signals. In addition, the acceleration sensor may also be an acceleration sensor with four axes or more. The acceleration sensor is preferably a MEMS acceleration sensor, which is internally integrated with a microprocessor, so that a motion acceleration of the wireless earphone during the wearing process can be collected, and the generated analog voltage signal can be filtered and converted to obtain acceleration data in digital format. Then, a displacement L of the wireless earphone can be obtained by combining the acceleration data with time.

In other embodiments, the acceleration sensor can also be a position sensor. A real-time position of the wireless earphone can be directly obtained through the position sensor, and a relative distance between the real-time position and a position of the wireless earphone in the charging box is the displacement L.

After it is determined that the wireless earphone has been taken out of the charging box, the wireless earphone may be directly worn by a user, but may also not be directly worn. In this case, the displacement L may be used to initially determine whether the earphone is worn.

Specifically, the displacement L is compared with a second preset threshold L2 and a third preset threshold L3 in the data processing module 1, and if $L2 \leq L \leq L3$, an audio playback module 3 is controlled to emit a detection acoustic wave. L2 and L3 are empirical values, and represent a distance range between a charging box and a human ear, which are applicable to most people.

In S30, the audio playback module 3 is controlled to play a detection acoustic wave.

The audio playback module 3 may be a speaker, which may also be used to play audio. Compared with an electromagnetic wave signal, the acoustic wave has better propagation characteristics inside the ear with a complex structure, so that the accuracy of in-ear detection can be effectively improved and the misjudgment rate caused by a foreign object blocking transmission of the detection acoustic wave can be reduced.

In S40, a detection signal is acquired and acoustic parameters of the detection signal is identified, where the detection signal is generated from a reflected wave of the detection acoustic wave collected by an acoustic wave sensor.

In this embodiment, the acoustic wave sensor 4 is preferably an ultrasonic sensor. The ultrasonic wave has strong directivity, which can ensure the accuracy of the detection result.

In S50, it is determined whether the wireless earphone is worn in a user's ear based on the acoustic parameters.

Specifically, the acoustic parameters include a waveform parameter and a frequency parameter. It is determined whether the waveform parameter matches a first preset waveform; if the waveform parameter matches the first preset waveform, it is further determined whether the frequency parameter matches a first preset frequency; and if the frequency parameter matches the first preset frequency, it is determined that the wireless earphone is worn in a user's ear. If the waveform parameter does not match the first preset waveform or the frequency parameter does not match the first preset frequency, it is determined that the wireless earphone is not worn in the user's ear. If it is determined that the wireless earphone is not worn in the user's ear, S30 is repeatedly performed. The first preset waveform and first preset frequency can be set through big-data summarization, analysis and processing based on the characteristics of resonance waves in a cavity formed inside a human ear.

The in-ear detection method for the wireless earphone uses an acoustic wave to determine whether the wireless earphone is worn in the user's ear. Compared with the related art, the in-ear detection method for the wireless earphone does not need a photoelectric sensor, and thus does not need a light-transmitting opening on the wireless earphone, thereby simplifying the structure of the wireless earphone, reducing the manufacturing costs, and fully releasing design space of the wireless earphone to provide higher design flexibility. In addition, the position detection module 2 is configured to assist in determining whether the wireless earphone is taken out of the charging box and worn, so that the audio playback module 3 can be prevented from continuously emitting the ultrasonic wave and thus electric energy waste of the wireless earphone can be avoided.

Figure 2:
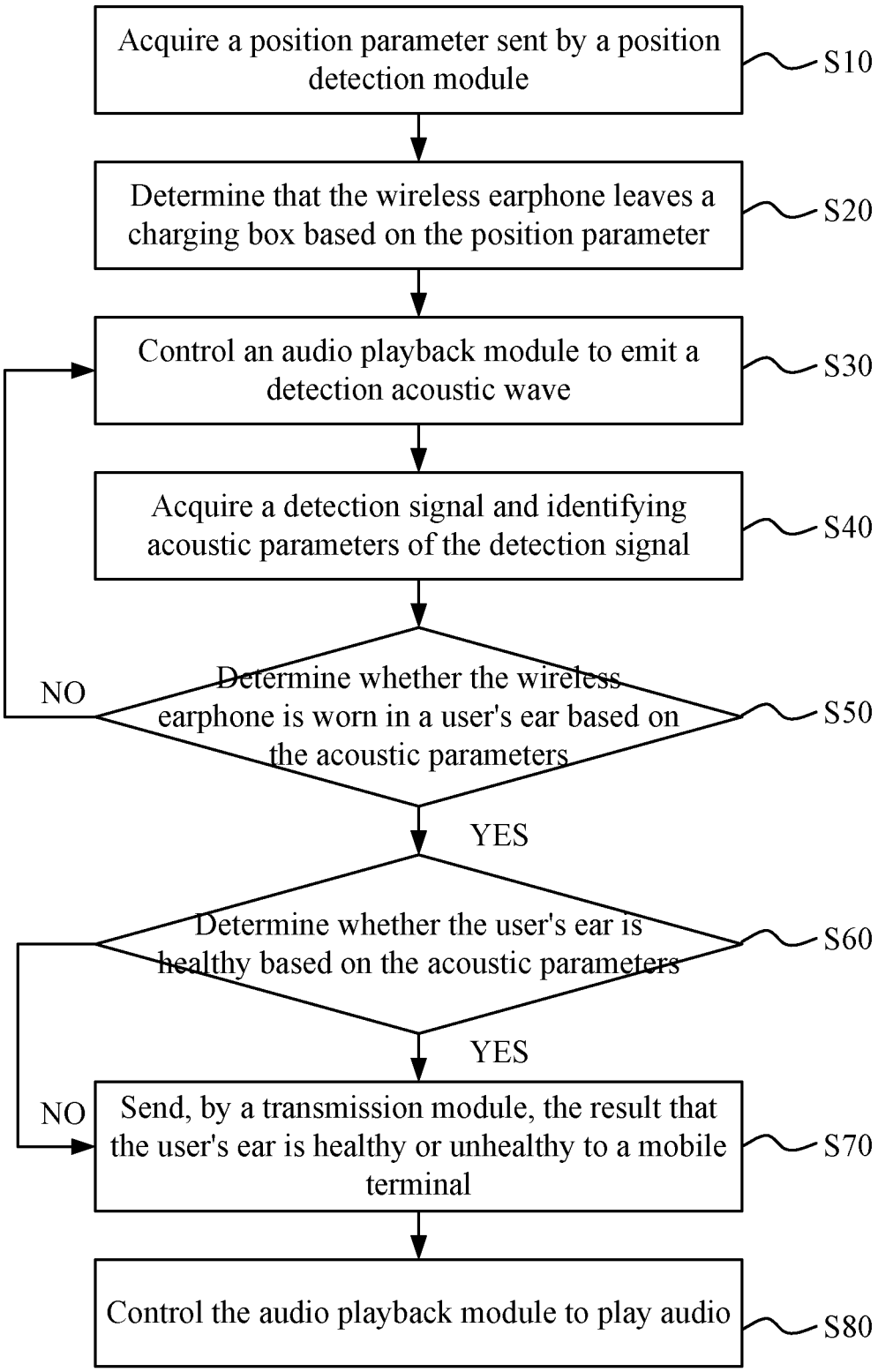
FIG. 2 is a second flowchart of the in-ear detection method for the wireless earphone according to the embodiment of the present disclosure.

Optionally, as shown in FIG. 2, after determining that the wireless earphone is worn in the user's ear, the in-ear detection method for the wireless earphone further includes S60 to S80 described below.

In S60, based on the acoustic parameters, it is determined whether the user's ear is healthy.

Specifically, it is determined whether the waveform parameter matches a second preset waveform and whether the frequency parameter matches a second preset frequency, where the second preset waveform and second preset frequency respectively represent a waveform and a frequency when the user's ear is healthy. If the waveform parameter matches the second preset waveform and the frequency parameter matches the second preset frequency, it is determined that the user's ear is healthy, otherwise it is determined that the user's ear is not healthy. The second preset waveform and the second preset frequency can be set through big data summarization, analysis and processing based on the characteristics of the resonance waves in a cavity formed inside a human ear. In this way, the wireless earphone can also have the function of detecting the health condition of the user's ear.

In S70, after it is determined that the user's ear is healthy or unhealthy, the data processing module 1 sends a result that the user's ear is healthy or unhealthy to a mobile terminal by a transmission module 5.

In this way, the user can learn about health states of his or her ears. The transmission module 5 is preferably Bluetooth. The mobile terminal may be a mobile phone, a tablet computer, or the like.

In Step 80, the audio playback module 3 is controlled to play audio.

Second Embodiment

This embodiment provides a wireless earphone. The wireless earphone includes a data processing module 1 as well as a position detection module 2, an audio playback module 3 and an acoustic wave sensor 4 that are connected to the data processing module 1. The position detection module 2 is configured to acquire a position parameter of the wireless earphone. The audio playback module 3 is configured to emit a detection acoustic wave after receiving a playback instruction. The acoustic wave sensor 4 is configured to collect a reflected wave of the detection acoustic wave and generate a detection signal. The data processing module 1 is configured to perform operations of receiving the position parameter and determining that the wireless earphone has left the charging box based on the position parameter; sending the playback instruction to the audio playback module 3; and receiving and identifying acoustic parameters of the detection signal and determining whether the wireless earphone is worn in a user's ear based on the acoustic parameters.

The wireless earphone further includes a transmission module 5 connected to the data processing module 1. The transmission module 5 is configured to receive a result that the user's ear is healthy or unhealthy sent by the data processing module 1 and send the result to a mobile terminal.

The wireless earphone can perform the in-ear detection method for the wireless earphone described above, and thus has function modules and beneficial effects corresponding to the in-ear detection method.

In addition, when the user forgets the position of the wireless earphone, for example, in a bag or a pocket, a search instruction can be sent through a mobile terminal. The data processing module 1 receives the search instruction through the transmission module 5, and then performs S30 and S40. Then, the data processing module 1 acquires a target waveform matching the waveform parameter from a plurality of target waveforms pre-stored in the data processing module 1 and a target frequency matching the frequency parameter from a plurality of target frequencies pre-stored in the data processing module 1. Subsequently, the data processing module 1 finds a target position corresponding to this target waveform and this target frequency from a corresponding chart of the target waveforms, target frequencies and target positions pre-stored in the data processing module 1, and then sends the target position to the mobile terminal through the transmission module 5 to help the user get the wireless earphone. It should be noted that the target position may be a pocket, a drawer, a backpack, a shoulder bag, or the like. Both the target waveform and the target frequency are obtained through big-data summarization, analysis and processing.

Apparently, the foregoing embodiments of the present disclosure are merely examples for clearly explaining the present disclosure, and are not intended to limit the embodiments of the present disclosure. For those of ordinary skill in the art, other different forms of changes or modifications can be made on the basis of the above description. There is no need and no way to enumerate all implementations. Any modification, equivalent substitution and improvement made within the spirit and principle of the present disclosure shall be included in the scope of the present disclosure.

What is claimed is:

1. An in-ear detection method for a wireless earphone, comprising:

acquiring a position parameter sent by a position detection module;

determining that the wireless earphone has left a charging box based on the position parameter;

controlling an audio playback module to emit a detection acoustic wave;

acquiring a detection signal and identifying acoustic parameters of the detection signal, the detection signal being generated from a reflected wave of the detection acoustic wave collected by an acoustic wave sensor;

determining whether the wireless earphone is worn in a user's ear based on the acoustic parameters; and if it is determined that the wireless earphone is worn in the user's ear, controlling the audio playback module to play audio, wherein the acoustic parameters comprise a waveform parameter and a frequency parameter, and determining whether the wireless earphone is worn in the user's ear based on the acoustic parameters comprises:

determining whether the waveform parameter matches a first preset waveform;

if the waveform parameter matches the first preset waveform, determining whether the frequency parameter matches a first preset frequency; and if the frequency parameter matches the first preset frequency, determining that the wireless earphone is worn in the user's ear.

2. The in-ear detection method for the wireless earphone of claim 1, wherein after determining that the wireless earphone is worn in the user's ear and prior to controlling the audio playback module to play audio, the in-ear detection method further comprises:

determining whether the user's ear is healthy based on the acoustic parameters.

3. The in-ear detection method for the wireless earphone of claim 2, wherein determining whether the user's ear is healthy based on the acoustic parameters comprises:

determining whether the waveform parameter matches a second preset waveform and whether the frequency parameter matches a second preset frequency; and if the waveform parameter matches the second preset waveform and the frequency parameter matches the second preset frequency, determining that the user's ear is healthy, otherwise determining that the user's ear is unhealthy.

4. The in-ear detection method for the wireless earphone of claim 3, wherein determining whether the user's ear is healthy based on the acoustic parameters further comprises:

if it is determined that the user's ear is healthy or unhealthy, sending, by a transmission module, a result that the user's ear is healthy or unhealthy to a mobile terminal.

5. The in-ear detection method for the wireless earphone of claim 1, wherein determining that the wireless earphone has left the charging box based on the position parameter comprises:

comparing a displacement L of the wireless earphone with a first preset threshold L1, wherein the position parameter is the displacement L of the wireless earphone; and if $L>L1$, determining that the wireless earphone has left the charging box.

6. The in-ear detection method for the wireless earphone of claim 5, wherein after determining that the wireless earphone has left the charging box and prior to controlling the audio playback module to emit the detection acoustic wave, the in-ear detection method further comprises:

comparing the displacement L with a second preset threshold L2 and a third preset threshold L3, wherein $L2<L3$; and if $L2 \leq L \leq L3$, controlling the audio playback module to emit the detection acoustic wave.

7. A wireless earphone, comprising a data processing module as well as a position detection module, an audio playback module and an acoustic wave sensor that are connected to the data processing module, wherein the position detection module is configured to acquire a position parameter of the wireless earphone;

the audio playback module is configured to emit a detection acoustic wave after receiving a playback instruction;

the acoustic wave sensor is configured to collect a reflected wave of the detection acoustic wave and generate a detection signal; and the data processing module is configured to perform operations of: receiving the position parameter and determining that the wireless earphone has left a charging box based on the position parameter; controlling the audio playback module to emit the detection acoustic wave; and receiving and identifying acoustic parameters of the detection signal and determining whether the wireless earphone is worn in a user's ear based on the acoustic parameters, wherein the data processing module is further configured to, if it is determined that the wireless earphone is worn in the user's ear, control the audio playback module to play audio; and wherein the acoustic parameters comprise a waveform parameter and a frequency parameter, and the operation of determining whether the wireless earphone is worn in the user's ear based on the acoustic parameters comprises:

determining whether the waveform parameter matches a first preset waveform;

if the waveform parameter matches the first preset waveform, determining whether the frequency parameter matches a first preset frequency; and if the frequency parameter matches the first preset frequency, determining that the wireless earphone is worn in the user's ear.

8. The wireless earphone of claim 7, further comprising a transmission module connected to the data processing module, the transmission module being configured to receive a result that the user's ear is healthy or unhealthy sent by the data processing module and send the result to a mobile terminal.

* * * * *